US006322622B1

(12) United States Patent
Matsunaga et al.

(10) Patent No.: US 6,322,622 B1
(45) Date of Patent: Nov. 27, 2001

(54) FLAME-SPRAYING POWDERY REPAIR MIXTURE

(75) Inventors: Hisahiro Matsunaga; Masato Kumagai; Yasumasa Fukushima, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/424,650

(22) PCT Filed: Oct. 13, 1998

(86) PCT No.: PCT/JP98/04615

§ 371 Date: Nov. 26, 1999

§ 102(e) Date: Nov. 26, 1999

(87) PCT Pub. No.: WO99/50470

PCT Pub. Date: Oct. 7, 1999

(30) Foreign Application Priority Data

Mar. 27, 1998 (JP) ..... 10-81892
Mar. 27, 1998 (JP) ..... 10-81893

(51) Int. Cl.[7] ..... C23C 4/10; F27D 1/16

(52) U.S. Cl. ..... 106/286.6; 106/18.12; 106/286.1; 106/286.5; 106/286.7; 106/287.34; 501/123; 501/125; 501/128; 501/133

(58) Field of Search ..... 106/18.11, 18.12, 106/286.1, 286.5, 286.6, 286.7, 287.34; 501/123, 125, 128, 133

(56) References Cited

U.S. PATENT DOCUMENTS 4,486,545 * 12/1984 Sugimoto et al. ..... 501/123
5,096,857 * 3/1992 Hu et al. ..... 501/21

FOREIGN PATENT DOCUMENTS 3-9185B 2/1991 (JP) .

* cited by examiner

*Primary Examiner*—Anthony Green
(74) *Attorney, Agent, or Firm*—Schnader Harrison Segal & Lewis LLP

(57) ABSTRACT

A flame spray mending material effective for applying a dense thermal spray mending layer to a silica brick wall of an industrial furnace, having a high crystallization ratio immediately after thermal spraying in a broad thermal spray condition, having an oxide concentration of 89% by weight or more of $SiO_2$, more than 2.0 to 4.0% by weight of $Na_2O$ and/or more than 0.2 to 4.0% by weight of $Li_2O$, having a 80% or more crystallization ratio after thermal spraying and 200 kgf/cm$^2$ or more compression strength. A slight amount of CaO may be present to make a flame spray mending material with an oxide concentration of 89% by weight or more of $SiO_2$, more than 2.0 to 5.0% by weight of CaO, 0.5 to 4.0% by weight of $Na_2O$ and/or more than 0.2 to 4.0% by weight of $Li_2O$, and 1.0% by weight of less of $Al_2O_3$.

6 Claims, 2 Drawing Sheets

FLAME-SPRAYING POWDERY REPAIR MIXTURE

TECHNICAL FIELD

The present invention relates to a powdery mixture for flame spray mending as a material for mending the internal wall of an industrial furnace, in particular, the internal wall of a coke oven in a high temperature state by melting a powdery refractory by flame for spray mending with a spray nozzle.

BACKGROUND ART

The inside of a furnace structure as an industrial furnace, in particular, a coke oven, a blast furnace, a steel manufacturing furnace, and the like, as the iron and steel making equipment, contacted with a molten material such as a carbonized coal, a molten iron, a molten steel, a slug, and the like, is in a severe environment exposed to a temperature as high as 1000° C. or more. In particular, at the time of the coke extruding operation from a coke oven carbonizing room, or of the operation of injecting, storing, or discharging a molten iron or a molten steel in a steel manufacturing furnace, the internal wall experiences a remarkable temperature change. Therefore, in the internal wall, not only a damage by melting by the penetrated molten material but also damages including cracks and peel-off by heat spalling are frequently encountered.

In order to cope with the various damage factors, an appropriate brick material needs to be selected at the time of designing or furnace construction as well as mending is required in order to prolong wall life.

For example, as the mending technology, a flame spray mending method, where a mending material is blown thermally to a refractory damage part, can be presented. The flame spray mending method is a technology where a flame spray mending material containing a mending flame resistant oxide powder or an easily oxidizable powder, or a mixture of both, having a composition substantially the same as that of the material of the furnace wall refractory to be mended is thermally blown mainly to a high temperature furnace internal wall surface. According to the method, the flame resistant oxide powder is melted by the combustion heat of a combustible gas, and the easily oxidizable powder becomes an oxide by being melted exothermically by its own combustion so that a spray mending layer can be formed with the flame resistant oxide powder. In particular, since the furnace temperature of a coke oven cannot be lowered except the time of rebuilding and thus the furnace wall mending is done as a prerequisite in a high temperature state, such a flame spray mending method is effective.

As a conventional technology concerning such a flame spray mending method, for example, the method disclosed in the official gazette of Japanese Examined Patent Publication No. 2-45110 can be presented. The method is a dry method comprising the steps of mixing a powdery flame resistant oxide with a combustible material and a combustible gas so as to be supplied to a combustion supporting gas containing oxygen including oxygen and air for thermally melting the flame resistant oxide powder by the heat of the combustion flame and blowing the same to the damage part of the internal wall of the furnace instantaneously. It is characteristic of the method that the spray mended refractory is highly durable compared with a refractory mended by a method where a material obtained by mixing water and a blowing material in advance so as to be a slurry is blown from a tank, that is, a wet blowing method.

As the thermal spray material to be used in such a flame spray mending method, for example, a highly siliceous thermal spray material containing 93.9 to 99.6% by weight or more of $SiO_2$, 1.5% by weight or less of $Al_2O_3$, 2.0% by weight or less of CaO, 1.0% by weight or less of $Fe_2O_3$, and 0.4 to 2.0% by weight of $Na_2O$ is proposed in the official gazette of Japanese Examined Patent Publication No. 3-9185. In general, this kind of material is a material having a 60% or more crystallization ratio immediately after thermal spraying where crack generation according to the expansion at the time of the crystallization of the amorphous (vitreous) part (<40%), and decline of the adhesion strength caused by the difference in the heat expansion characteristics between the thermal spray mending layer and the coke oven wall bricks are observed. That is, the material according to the above-mentioned proposal has been developed in order to overcome the problem derived from the low crystallization ratio.

However, the technology disclosed in the official gazette of Japanese Examined Patent Publication No. 3-9185 has a problem in that the thermal spray condition for having a thermal spray mending layer with a 60% or more crystallization ratio in the material, that is, the oxygen gas flow rate, and the propane gas flow rate is limited in an extremely narrow range. Furthermore, with the thermal spray condition capable of obtaining a thermal spray mending layer with a 60% or more crystallization ratio, a dense thermal spray mending layer, that is, a thermal spray mending layer having a high compression strength cannot be obtained easily, and thus a problem is involved in that the wear resistance is poor and the life of the thermal spray mending layer is short.

Moreover, as the $SiO_2$ material, which is the main component of the conventional thermal spray mending material, silica brick scrap is used frequently for reduction of the cost. However, when the brick scrap is used as the material, a lot of impurities are introduced. In particular, since CaO is a substance broadly present as a binder in silica brick production, CaO is introduced inevitably and thus it is difficult to limit the amount of CaO component to 2% by weight or less. Besides, since CaO has a strong effect of lowering the crystallization ratio immediately after thermal spraying in a $SiO_2$ thermal spray coat layer, the crystallization ratio needs to be improved by adjusting the other components when the CaO component is present in a large amount.

As heretofore explained, problems still remained for the conventional technology include tendency of crack generation in the mended layer and a low adhesion strength with respect to the base material surface. It has problems at least in that the need for improving the crystallization ratio is severe and the compression strength cannot be improved so that the wear resistance is poor and the wall life is short.

In order to improve the product crystallization ratio immediately after thermal spraying of the flame spray mending material mainly containing SiO2, it is of course effective to eliminate a component disturbing the crystallization, but there is a limitation for the use of a highly pure material in view of the high material cost. For that reason, conventionally, silica brick scrap has been reused in most cases as the $SiO_2$ material. On the other hand, as a flame spray mending material, one having an 80% or more crystallization ratio immediately after thermal spraying, even in a condition where CaO is inevitably introduced from the silica brick scrap, and satisfying a 200 $kgf/cm^2$ compression strength, is required for mending a coke oven wall brick.

Accordingly, an object of the present invention is to provide a thermal spray mending material having a high crystallization ratio immediately after thermal spraying and effective in dealing with a dense thermal spray mending layer in a broad thermal spray condition. Moreover, another object of the present invention is to provide a thermal spray mending material having excellent wear resistance and durability (life) by ensuring a high compression strength on one hand without the risk of a mending layer crack or a decline in the adhesion strength with respect to the mending surface.

Still another object of the present invention is to obtain a thermal spray material capable of producing a thermal spray layer having an 80% or more crystallization ratio immediately after thermal spraying and a high compression strength (>200 kgf/cm$^2$) even when CaO is inevitably introduced in silica brick scrap to some extent.

DISCLOSURE OF INVENTION

As the result of the elaborate study on the above-mentioned problems of the conventional technology, the present inventors have developed a powdery mixture as a flame spray mending material effective in obtaining a thermal spray mending layer having an 80% or more crystallization ratio immediately after thermal spraying, and having a high compression strength in a broad thermal spraying condition.

That is, the present invention basically is a powdery mixture for flame spray mending having an oxide concentration of 89% by weight or more of $SiO_2$, more than 2.0 to 4.0% by weight of $Na_2O$ and silica brick scrap and other inevitable impurities as the remainder. The second aspect of the present invention is a powdery mixture for flame spray mending having an oxide concentration of 89% by weight or more of $SiO_2$, 0.2 to 4.0% by weight of $Li_2O$ and the aforesaid inevitable impurities as the remainder. The third aspect of the present invention is a powdery mixture for flame spray mending with an oxide concentration of 89% by weight or more of $SiO_2$, 0.2% by weight or more of Li2O, more than 0.2 to 4.0% by weight of ($Na_2O$+$Li_2O$) and inevitable impurities as the remainder.

The fourth aspect of the present invention is a powdery mixture for flame spray mending with an oxide concentration of 89% by weight or more of $SiO_2$, more than 2.0 to 5.0% by weight of CaO, 0.5 to 4.0% by weight of $Na_2O$, 1.0% by weight or less of $Al_2O_3$ and inevitable impurities as the remainder. The fifth aspect of the present invention is a powdery mixture for flame spray mending with an oxide concentration of 89% by weight or more of $SiO_2$, more than 2.0 to 5.0% by weight of CaO, more than 0.2 to 4.0% by weight of $Li_2O$, 1.0% by weight or less of $Al_2O_3$ and inevitable impurities as the remainder. The sixth aspect of the present invention is a powdery mixture for flame spray mending with an oxide concentration of 89% by weight or more of $SiO_2$, more than 2.0 to 5.0% by weight of CaO, 0.2% by weight or more of $Li_2O$, more than 0.2 to 4.0% by weight of ($Na_2O$+$Li_2O$), 1.0% by weight or less of $Al_2O_3$ and inevitable impurities as the remainder.

In the present invention, a preferable embodiment is a powdery mixture capable of forming a thermal spray mending layer indicating a 80% or more crystallization ratio in the coat layer immediately after flame spraying and a 200 kgf/cm$^2$ or more compression strength.

The concentration as an oxide here stands for the amount (% by weight) of the components such as oxide, carbonate and metal remained after eliminating the moisture contained in the material, based on the oxide as 100.

Figure 1:
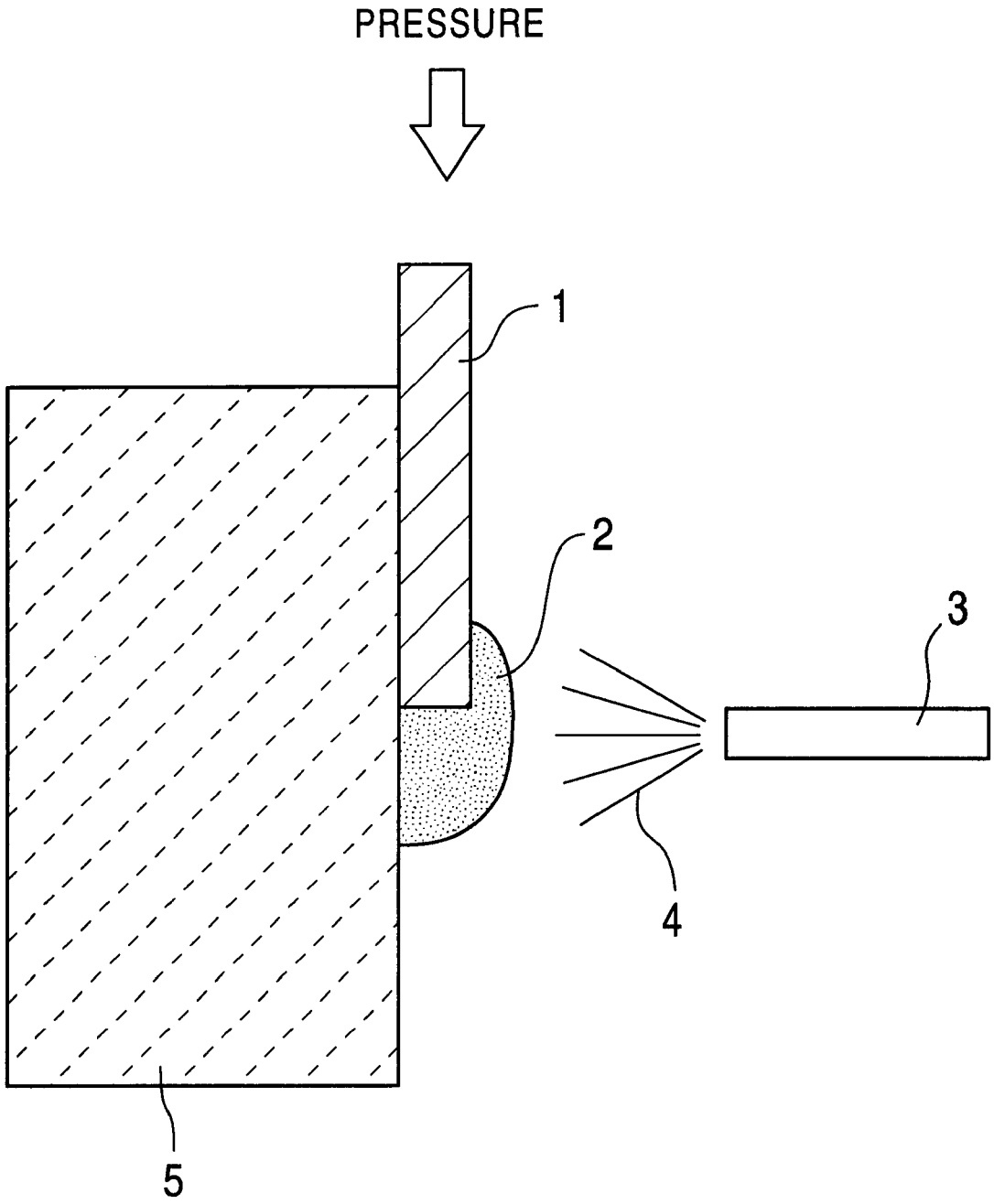
FIG. 1 is a diagram for explaining the method for measuring the adhesion strength.

<Reference Numerals>1 push rod 2 thermal spraying layer 3 thermal spraying nozzle 4 thermal spraying material 5 silica brick

BEST MODE FOR CARRYING OUT THE INVENTION

The present invention contains $SiO_2$ as the main component. $SiO_2$ is the component substantially the same as a silica brick used for the furnace wall internal surface of a coke oven. When the internal wall surface is a part to be mended, this is the component prerequisite for substantially coinciding the heat expansion characteristics of the furnace wall brick and the thermal spray mending refractory layer.

In the present invention, the amount of $SiO_2$ is 89% by weight or more based on the concentration converted to an oxide. The reason of the limitation is that with a less than 89% by weight SiO2 amount, the amount of the impurity components inevitably introduced, such as $Al_2O_3$, FeO, CaO, $Fe_2O3$, and the like, becomes large and thus the crystallization ratio of the mending layer immediately after thermal spraying is lowered to less than 80% by the influence. If the crystallization ratio of the mending layer immediately after thermal spraying becomes less than 80%, cracks can be easily generated in the bonded surfaces of both according to the heat expansion difference between the mending layer and the furnace wall bricks at the time of 100% crystallization of the thermal spray mending layer so that the thermal spray mending layer is peeled off. As the $SiO_2$ component material in the present invention, silica brick scrap, silica rock, silica sand, and the like, can be used.

The expression "crystallization ratio" herein denotes the sum of each weight percentage (% by weight) of cristobalite, trydymite and quartz by quantitative analysis of the thermal spray mending layer by X-ray analysis. The crystallization ratio can be represented by the below-mentioned formula Crystallization ratio (% by weight)=cristobalite+trydymite+quartz In general, the thermal spraying layer made of an $SiO_2$ material has both a crystallized part and a vitrified part generated in the layer. Among these, the vitrified part undergoes phase transformation by being maintained at a temperature of about 1000° C. inside the furnace wall so as to be gradually crystallized. Since expansion is generated according to the phase transformation in the crystallization process, stress is generated inside the thermal spraying layer to become fragile. Besides, since the adhesion between the silica brick surface to be mended and the thermal spraying layer becomes weak due to the expansion, peel-off of the thermal spraying layer can easily be generated on the silica brick surface. In this context, a preferable mending material needs to have a high crystallization ratio immediately after thermal spraying and resistance to expansion of the thermal spraying layer even when the crystallization of the thermal spraying layer proceeds subsequently.

According to the study of the present inventors, it was learned that when the crystallization ratio of the mending layer immediately after thermal spraying is 80%, the adhesion strength declines by about 30% when it is crystallized thereafter. And it was confirmed that the damage on the furnace wall caused by the peel-off of the thermal spraying layer is not so remarkable if the decline of the adhesion strength is 30% or less. That is, the reason the crystallization ratio after thermal spraying is set to be 80% or more in the present invention is based on this point.

The adhesion strength here is compared by the figure in the method shown in FIG. 1, which can be sought as mentioned below.

① With a push rod (a refractory having a 20×200 mm rectangular cross-section) pressed on the side surface of a silica brick, a mending material (about 500 g) is flame sprayed below the push rod.

② The pressing force of the push rod when the thermal spray mending layer is peeled off from the silica brick by pressing the push rod from above is measured by the below-mentioned formula and is defined as the adhesion strength.

$$\text{Adhesion strength} = \frac{\text{push rod pressing force (kg/cm}^2)\times \text{push rod cross-sectional area (cm}^2) + \text{push rod weight (kg)}}{\text{adhesion area between the brick and the thermal spraying layer (cm}^2)}$$

A material according to the present invention contains a predetermined amount of $Na_2O$ and/or $Li_2O$ in addition to $SiO_2$. By having such a component composition, the crystallization of the thermal spray mending layer immediately after thermal spraying can be promoted so as to form a dense and firm mending layer having a 200 kgf/cm$^2$ or more compression strength. If the compression strength of the thermal mending layer is 200 kgf/cm$^2$, the wear resistance with respect to coke extrusion in a coke oven is sufficient as well. The above-mentioned compression strength is a value measured based on the testing method of the compression strength of a flame resistant brick defined by the JIS R2206. Here specimens were cut out from the thermal spray mending layer formed by thermally spraying a thermal spray mending material to the silica brick surface by 80 mm or more thickness so as to be provided for testing.

The amount of $Na_2O$, which is a component to be added, based on the refractory concentration is set to be in the range of 2.0 to 4.0% by weight. The reason thereof is that it is difficult to obtain a thermal spray mending layer having a 200 kgf/cm$^2$ or more compression strength to leave a problem in the wear resistance with less than 2% of $Na_2O$. On the other hand, with more than 4% by weight of $Na_2O$, since the crystallization ratio of the mending layer immediately after thermal spraying cannot reach 80%, the thermal spray mending layer is easily peeled off. A preferable $Na_2O$ amount is 2.1 to 3.0% by weight. As the $Na_2O$ source, sodium silicate, sodium carbonate, and the like, are preferable but other materials can be used as well.

In a material containing more than 2.0 to 5.0% by weight of CaO, the amount of $Na_2O$, which is a component to be added, based on the oxide concentration is set to be in the range of 0.5 to 4.0% by weight. The reason thereof is that it is difficult to obtain a thermal spray mending layer having a 200 kgf/cm$^2$ or more compression strength to leave a problem in the wear resistance with less than 0.5% of $Na_2O$. On the other hand, with more than 4% by weight of $Na_2O$, since the crystallization ratio of the mending layer immediately after thermal spraying cannot reach 80%, the thermal spray mending layer is easily peeled off. A preferable $Na_2O$ amount is 1.0 to 3.0% by weight. As the $Na_2O$ source, sodium silicate, sodium carbonate, and the like, are preferable but other materials can be used as well.

$Li_2O$ is added by 0.2 to 4.0% by weight based on the oxide concentration. In general, $Li_2O$ has the effect of improving the crystallization ratio of the thermal spray mending layer with a small amount compared with $Na_2O$. With a 0.2% by weight or less $Li_2O$ amount, it is difficult to obtain a thermal spray mending layer with a 200 kgf/cm$^2$ or more compression strength and the wear resistance is insufficient. On the other hand, with an amount exceeding 4.0% by weight, since the crystallization ratio of the thermal spray mending layer cannot reach 80%, the thermal spray mending layer is easily peeled off. A preferable range of the $Li_2O$ amount is 0.3 to 1.0% by weight. As an $Li_2O$ source, a material such as lithium carbonate can be used.

In the present invention, when both $Li_2O$ and $Na_2O$ are contained, an effect the same as or more than the above-mentioned can be achieved. That is, ($Li_2O$+$Na_2O$) is set to be in a range of more than 0.2 to 4.0% by weight. With a less than 0.2% by weight total amount thereof, it is difficult to obtain a thermal spray mending layer having a 200 kgf/cm$^2$ or more compression strength. On the other hand, with more than 4% by weight, the crystallization ratio of the mending layer immediately after thermal spraying cannot reach 80% and thus a problem is involved in the peel-off of the thermal spraying layer. A range of 0.3% by weight $\leqq$($Li_2O$+$Na_2O$) $\leqq$2.5% by weight is preferable.

Figure 2:
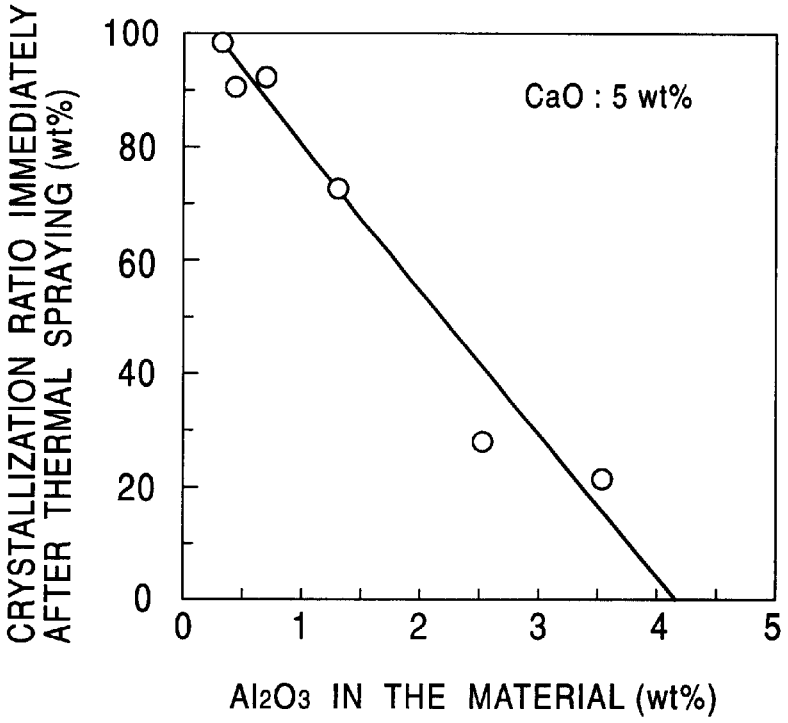
FIG. 2 is a graph showing the relationship between the $Al_2O_3$ concentration in the material and the crystallization ratio immediately after spraying.
Figure 3:
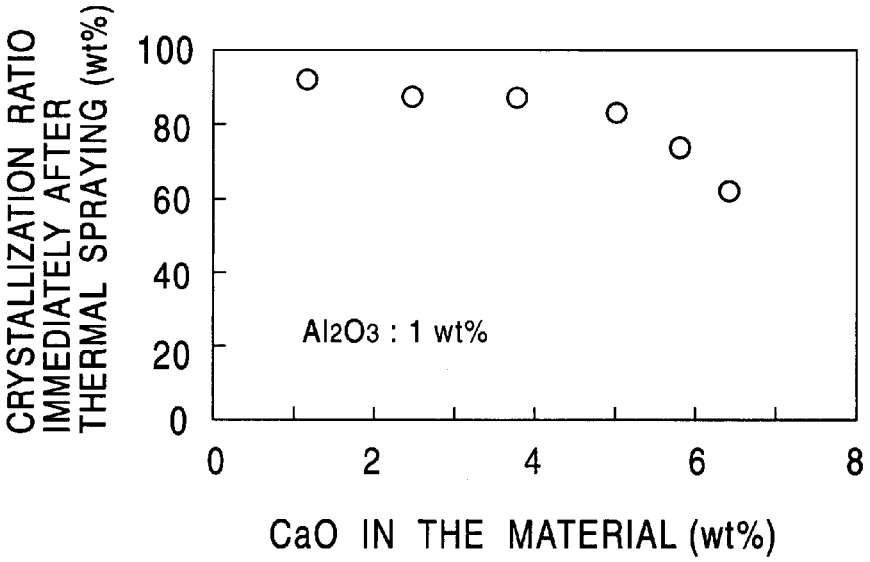
FIG. 3 is a graph showing the relationship between the CaO concentration in the material and the crystallization ratio immediately after spraying.

When CaO is contained by more than 2.0 to 5.0% by weight, $Al_2O_3$ needs to be restrained to 1% by weight or less. The reason thereof is that even when the CaO amount is restrained to 5% by weight or less, unless $Al_2O_3$, which is a substance to lower the crystallization ratio immediately after thermal spraying, is kept at 1% by weight or less, the CaO amount control is meaningless. FIG. 2 shows the crystallization ratio of the thermal spraying layer immediately after thermal spraying when $Al_2O_3$ is changed in a thermal spraying material containing 5% by weight of CaO and 0.5% by weight of $Li_2O$. The fuel gas and oxygen at the time of thermal spraying were controlled as needed so as to have a 200 to 300 kgf/cm$^2$ compression strength in each thermal spraying layer. As shown in this figure, when 5% by weight of CaO is contained, with an $Al_2O_3$ concentration exceeding 1.0% by weight, the crystallization ratio immediately after thermal spraying becomes 80% or less. FIG. 3 shows the crystallization ratio immediately after thermal spraying in the thermal spraying layer when the CaO amount is changed in a thermal spraying material containing 1% by weight of $Al_2O_3$. It can be learned that the crystallization ratio of 80% or more can be maintained with 5% by weight or less CaO even if 1% by weight of $Al_2O_3$ is contained.

In the present invention, components other than SiO2, $Na_2O$ and $Li_2O$ are inevitably introduced impurities. As such components, oxides such as $Al_2O_3$, CaO, $Fe_2O3$, TiO2, $K_2O$ can be considered. In particular, since $Al_2O_3$ has a strong tendency to disturb the crystallization, it is preferable to have it at 1.0% by weight or less.

The grain size of the materials according to the present invention is not particularly limited, but it is preferable to have a 0.15 mm or less grain size. This is because a large amount of a fuel gas and oxygen for melting the material are needed if the material grain size is coarse.

As a first embodiment of the present invention, one having the composition adjustment to have 89% by weight or more of $SiO_2$ and 2.1 to 4.0% by weight of $Na_2O$ based on the oxide concentration when 3.6 to 6.8% by weight of sodium carbonate is added to a silica material containing 93% by weight or more $SiO_2$ can be presented. As a second embodiment of the present invention, one having the composition adjustment to have 89% by weight or more of $SiO_2$ and 0.2 to 4.0% by weight of $Li_2O$ based on the oxide concentration when 0.5 to 9.9% by weight of lithium carbonate is added to a silica material containing 93% by weight or more $SiO_2$ can be presented. As a third embodiment of the present invention, one having the composition adjustment to have 89% by weight or more of $SiO_2$, 0.2% by weight or more of $Li_2O$, and more than 2.0 to 4.0% by weight of ($Na_2O$+$Li_2O$) based on the oxide concentration when 3.6% by weight or more of sodium carbonate and lithium carbonate so as to have 3.6 to 9.9% by weight of (sodium carbonate+lithium carbonate) are added to a silica material containing 93% by weight or more $SiO_2$ can be presented.

As a fourth embodiment of the present invention, one having the composition adjustment to have 89% by weight or more of $SiO_2$, 2.1 to 4.0% by weight of $Na_2O$, more than 2.0 to 5.0% by weight of CaO, and 1.0% by weight or less of $Al_2O_3$ based on the oxide concentration when 3.6 to 6.8% by weight of sodium carbonate and sodium silicate are added to a silica rock, silica brick scrap, or silica sand material containing 93% by weight or more $SiO_2$ is preferable. As a fifth embodiment of the present invention, one having the composition adjustment to have 89% by weight or more of $SiO_2$, 0.2 to 4.0% by weight of $Li_2O$, more than 2.0 to 5.0% by weight of CaO, and 1.0% by weight or less of $Al_2O_3$ based on the oxide concentration when 0.5 to 9.9% by weight of lithium carbonate is added to a silica rock, silica brick scrap, or silica sand material containing 93% by weight or more $SiO_2$ is preferable. As a sixth embodiment of the present invention, one having the composition adjustment to have 89% by weight or more of $SiO_2$, more than 0.2% by weight of $Li_2O$, 0.2 to 4.0% by weight of ($Na_2O$+$Li_2O$), more than 2.0 to 5.0% by weight of CaO, and 1.0% by weight or less of $Al_2O_3$ based on the oxide concentration when 0.5% by weight or more of lithium carbonate and lithium carbonate so as to have 0.5 to 6.5% by weight of (sodium carbonate+lithium carbonate) are added to a silica rock material containing 93% by weight or more $SiO_2$ is preferable.

The reason why sodium carbonate is used as the $Na_2O$ source and lithium carbonate is used as the $Li_2O$ source in the above-mentioned embodiments is that sodium carbonate and lithium carbonate can be handled easily and are easily melted at the time of thermal spraying so as to be reacted with $SiO_2$ easily. Further, it is preferable to mix with the materials homogeneously.

EXAMPLES

Hereinafter the present invention will be explained specifically with reference to examples.

Example 1

The materials (grain size—0.15 mm) having the chemical composition shown in Table 1 (present invention examples) and Table 2 (comparative examples) were thermal sprayed by a thermal spray amount 50 kg/h by the gas flow rate ($Nm^3$/h) shown in the same table to the furnace wall (silica brick) of a coke oven having a 750° C. furnace wall temperature so as to form a thermal spray mending layer. The thickness of the thermal spray mending layer was about 25 mm. The thermal spray mending layer was collected at 3 minutes after thermal spraying and the compression strength and the crystallization ratio by the X-ray analysis were measured. Further, the adhesion strength with the silica brick was measured at 10 minutes after thermal spraying after 100% crystallization by maintaining the thermal spray mending layer at 1200° C. The melting ratio of the material at the time of thermal spraying was 90% or more in all the cases. The measurement results are also shown in Table 1 and Table 2.

As apparent from the above-mentioned measurement results, in a material according to the present invention with the oxide concentration of (1) 89% by weight or more of $SiO_2$, and 2.1 to 4.0% by weight of $Na_2O$, (2) 89% by weight or more of $SiO_2$, and 0.2 to 4.0% by weight of $Li_2O$, and (3) 89% by weight or more of $SiO_2$, 0.2% by weight or more of $Li_2O$ and more than 2.1 to 4.0% by weight of ($Na_2O$+$Li_2O$), the crystallization ratio at 3 minutes after thermal spraying was 80% or more in all the cases and a 200 kgf/$cm^2$ or more compression strength was shown. Further, since these materials according to the present invention have a 80% or more crystallization ratio at 3 minutes after thermal spraying and a 200 kgf/$cm^2$ or more compression strength in a range with a ±15% or more gas flow rate of propane and oxygen, they satisfy the characteristics required to a high temperature furnace wall mending material for a coke oven. Besides, the reduction of the adhesion strength with respect to a silica brick after 100% crystallization was 30% or less in all the cases.

Example 2

The materials (grain size—0.15 mm) having the chemical composition shown in Table 3 (present invention examples) and Table 4 (comparative examples) were thermal sprayed by a thermal spray amount 50 kg/h by the gas flow rate ($Nm^3$/h) shown in the same table to the furnace wall (silica brick) of a coke oven having a 750° C. furnace wall temperature so as to form a thermal spray mending layer. The thickness of the thermal spray mending layer was about 50 mm. The thermal spray mending layer was collected at 3 minutes after thermal spraying and the compression strength based on the JIS R2206 (test piece: 25 mm×60 mm×60 mm) and the crystallization ratio by the powder X-ray analysis were measured. Further, the adhesion strength with the silica brick was measured at minutes after thermal spraying after 100% crystallization by maintaining the thermal spray mending layer at 1200° C. The melting ratio of the material at the time of thermal spraying was 90% or more in all the cases so as to eliminate the influence of the strength difference depending upon the melting state of the thermal spray mending layer. The measurement results are also shown in Table 3 and Table 4.

As apparent from the above-mentioned measurement results, when 2.0 to 5.0% by weight of CaO is contained in a material according to the present invention with the oxide concentration of (1) 89% by weight or more of SiO2, and 0.2 to 4.0% by weight of $Li_2O$, and 1.0% by weight or less of $Al_2O_3$, (2) 89% by weight or more of $SiO_2$, 0.5 to 4.0% by weight of $Na_2O$, and 1.0% by weight or less of $Al_2O_3$, and (3) 89% by weight or more of $SiO_2$, 0.2% by weight or more of $Li_2O$ and 0.2 to 4.0% by weight of ($Na_2O$+$Li_2O$), and 1.0% by weight or less of $Al_2O_3$, the crystallization ratio at 3 minutes after thermal spraying was 80% or more in all the cases and a 200 kgf/$cm^2$ or more compression strength was shown. Further, since these materials according to the present invention have a 80% or more crystallization ratio at 3 minutes after thermal spraying and a 200 kgf/$cm^2$ or more compression strength in a range with a ±15% or more gas flow rate of propane and oxygen, they satisfy the characteristics required to a high temperature furnace wall mending material for a coke oven. Besides, the lowering ratio of the adhesion strength with respect to a silica brick after 100% crystallization was 30% or less in the present invention whereas it is more than 70% in the comparative examples.

TABLE 1

| | Chemical composition (wt %) (concentration as an oxide) | | | | Gas flow rate ($Nm^3/h$) | | Crystallization ratio at 3 minutes after thermal spraying (wt %) | Adhesion strength with respect to silica brick ($kg/cm^2$) | |
|---|---|---|---|---|---|---|---|---|---|
| | $SiO_2$ | $Na_2O$ | $Li_2O$ | Others* | $C_3H_5$ | $O_2$ | | 10 minutes after thermal spraying | After 100% crystallization |
| Example 1 | 97.0 | 2.1 | — | 0.9 | 22 | 175 | 94 | 210 | 200 |
| Example 2 | 96.5 | 2.1 | — | 1.4 | 22 | 175 | 98 | 250 | 240 |
| Example 3 | 95.6 | 3.0 | — | 1.4 | 19 | 150 | 92 | 230 | 190 |
| Example 4 | 94.7 | 4.0 | — | 1.3 | 16 | 130 | 81 | 190 | 150 |
| Example 5 | 89.0 | 3.0 | — | 8.0 | 19 | 150 | 82 | 170 | 140 |
| Example 6 | 96.5 | 2.1 | — | 1.4 | 22 | 175 | 97 | 160 | 150 |
| Example 7 | 98.3 | — | 0.2 | 1.5 | 27 | 215 | 85 | 200 | 150 |
| Example 8 | 98.0 | — | 0.5 | 1.5 | 25 | 200 | 97 | 260 | 250 |
| Example 9 | 96.6 | — | 2.0 | 1.4 | 19 | 150 | 89 | 190 | 150 |
| Example 10 | 94.7 | — | 4.0 | 1.3 | 16 | 130 | 80 | 200 | 170 |
| Example 11 | 89.0 | — | 4.0 | 7.0 | 21 | 170 | 82 | 170 | 120 |
| Example 12 | 96.3 | 2.1 | 0.2 | 1.4 | 20 | 160 | 97 | 210 | 200 |
| Example 13 | 95.2 | 2.5 | 1.0 | 1.3 | 17 | 135 | 86 | 130 | 100 |
| Example 14 | 94.7 | 2.1 | 1.9 | 1.3 | 16 | 130 | 80 | 180 | 160 |
| Example 15 | 98.3 | 0.1 | 0.2 | 1.4 | 27 | 215 | 80 | 220 | 210 |

| | Adhesion strength by the crystallization | | Compression strength | | |
|---|---|---|---|---|---|
| | Lowering ratio (%) | Evaluation ≦30% is preferable | ($kgf/cm^2$) | Evaluation ≧200 $kgf/cm^2$ is preferable | Comprehensive evaluation |
| Example 1 | 5 | ○ | 1010 | ○ | ○ |
| Example 2 | 4 | ○ | 1150 | ○ | ○ |
| Example 3 | 17 | ○ | 990 | ○ | ○ |
| Example 4 | 21 | ○ | 950 | ○ | ○ |
| Example 5 | 18 | ○ | 590 | ○ | ○ |
| Example 6 | 6 | ○ | 350 | ○ | ○ |
| Example 7 | 25 | ○ | 330 | ○ | ○ |
| Example 8 | 4 | ○ | 850 | ○ | ○ |
| Example 9 | 21 | ○ | 790 | ○ | ○ |
| Example 10 | 15 | ○ | 530 | ○ | ○ |
| Example 11 | 29 | ○ | 470 | ○ | ○ |
| Example 12 | 5 | ○ | 1070 | ○ | ○ |
| Example 13 | 23 | ○ | 410 | ○ | ○ |
| Example 14 | 11 | ○ | 880 | ○ | ○ |
| Example 15 | 5 | ○ | 300 | ○ | Q |

*Others include inevitable impurities such as $Al_2O_3$, CaO, $Fe_2O_3$, $TiO_2$ and $K_2O$.

TABLE 2

| | Chemical composition (wt %) (concentration as an oxide) | | | | Gas flow rate ($Nm^3/h$) | | Crystallization ratio at 3 minutes after thermal spraying (wt %) | Adhesion strength with respect to silica brick ($kg/cm^2$) | |
|---|---|---|---|---|---|---|---|---|---|
| | $SiO_2$ | $Na_2O$ | $Li_2O$ | Others* | $C_3H_5$ | $O_2$ | | 10 minutes after thermal spraying | After 100% crystallization |
| Comparative example 1 | 98.5 | — | — | 1.5 | 27 | 200 | 0 | 62 | 0 |
| Comparative example 2 | 98.0 | 0.5 | — | 1.5 | 25 | 200 | 65 | 100 | 15 |
| Comparative example 3 | 96.6 | 1.9 | — | 1.5 | 23 | 185 | 90 | 150 | 110 |
| Comparative example 4 | 94.3 | 4.5 | — | 1.2 | 15 | 120 | 62 | 170 | 25 |
| Comparative example 5 | 87.0 | 3.0 | — | 10.0 | 19 | 150 | 60 | 120 | 22 |
| Comparative example 6 | 98.4 | — | 0.1 | 1.5 | 27 | 215 | 45 | 85 | 10 |
| Comparative example 7 | 94.5 | — | 4.2 | 1.3 | 15 | 120 | 76 | 42 | 7 |
| Comparative example 8 | 87.0 | — | 3.0 | 10.0 | 19 | 150 | 45 | 170 | 15 |

TABLE 2-continued

| | | | | | | | | | |
|---|---|---|---|---|---|---|---|---|---|
| Comparative example 9 | 94.4 | 2.5 | 1.8 | 1.3 | 15 | 120 | 53 | 200 | 20 |

| | Adhesion strength by the crystallization | | Compression strength | | |
|---|---|---|---|---|---|
| | Lowering ratio (%) | Evaluation ≦30% is preferable | (kgf/cm$^2$) | Evaluation ≧200 kgf/cm$^2$ is preferable | Comprehensive evaluation |
| Comparative example 1 | 98 | x | 150 | x | x |
| Comparative example 2 | 85 | x | 120 | x | x |
| Comparative example 3 | 27 | ○ | 180 | x | x |
| Comparative example 4 | 85 | x | 710 | ○ | x |
| Comparative example 5 | 82 | x | 380 | ○ | x |
| Comparative example 6 | 88 | x | 210 | ○ | x |
| Comparative example 7 | 83 | x | 450 | ○ | x |
| Comparative example 8 | 91 | x | 530 | ○ | x |
| Comparative example 9 | 90 | x | 520 | ○ | x |

*Others include inevitable impurities such as $Al_2O_3$, CaO, $Fe_2O_3$, $TiO_2$ and $K_2O$.

TABLE 3

| | Chemical composition (wt %) (concentration as an oxide) | | | | | | | | Gas flow rate (Nm$^3$/h) | | Crystallization ratio at 3 minutes after thermal spraying (wt %) | Adhesion strength with respect to silica brick (kg/cm$^2$) | |
|---|---|---|---|---|---|---|---|---|---|---|---|---|---|
| | $SiO_2$ | CaO | $Fe_2O_3$ | $Al_2O_3$ | $Li_2O$ | $Na_2O$ | $K_2O$ | Others* | $C_3H_5$ | $O_2$ | | 10 minutes after thermal spraying | After 100% crystallization |
| Example 16 | 95.2 | 3.0 | 0.4 | 0.5 | 0.2 | — | 0.1 | 0.6 | 24 | 190 | 90 | 280 | 250 |
| Example 17 | 94.2 | 3.0 | 0.4 | 0.5 | 1.0 | — | 0.1 | 0.8 | 23 | 185 | 98 | 350 | 340 |
| Example 18 | 90.8 | 3.0 | 0.4 | 0.5 | 4.0 | — | 0.1 | 1.2 | 16 | 130 | 88 | 290 | 250 |
| Example 19 | 92.1 | 3.0 | 0.4 | 0.5 | — | 0.5 | 0.1 | 3.4 | 20 | 160 | 83 | 180 | 140 |
| Example 20 | 93.0 | 3.0 | 0.4 | 0.5 | — | 2.1 | 0.1 | 0.9 | 19 | 150 | 100 | 450 | 450 |
| Example 21 | 91.0 | 3.0 | 0.4 | 0.5 | — | 4.0 | 0.1 | 1.0 | 16 | 130 | 97 | 320 | 320 |
| Example 22 | 93.8 | 3.0 | 0.4 | 1.0 | 0.5 | — | 0.1 | 1.2 | 23 | 185 | 100 | 400 | 400 |
| Example 23 | 92.3 | 5.0 | 0.4 | 1.0 | 0.5 | — | 0.1 | 0.7 | 23 | 185 | 81 | 310 | 240 |
| Example 24 | 92.5 | 3.0 | 0.4 | 1.0 | — | 2.1 | 0.1 | 0.9 | 19 | 150 | 98 | 250 | 230 |
| Example 25 | 89.0 | 5.0 | 0.4 | 1.0 | — | 2.1 | 0.1 | 2.4 | 19 | 150 | 82 | 240 | 170 |
| Example 26 | 94.2 | 3 | 0.4 | 0.5 | 0.2 | 0.7 | 0.1 | 0.9 | 21 | 170 | 100 | 330 | 330 |
| Example 27 | 89.7 | 3 | 0.4 | 0.5 | 0.2 | 3.8 | 0.1 | 2.3 | 16 | 130 | 84 | 270 | 200 |
| Example 28 | 89.7 | 3 | 0.4 | 0.5 | 3.8 | 0.2 | 0.1 | 2.3 | 16 | 130 | 85 | 290 | 260 |

| | Adhesion strength by the crystallization | | Compression strength | | |
|---|---|---|---|---|---|
| | Lowering ratio (%) | Evaluation ≦30% is preferable | (kgf/cm$^2$) | Evaluation ≧200 kgf/cm$^2$ is preferable | Comprehensive evaluation |
| Example 16 | 11 | ○ | 350 | ○ | ○ |
| Example 17 | 3 | ○ | 500 | ○ | ○ |
| Example 18 | 14 | ○ | 340 | ○ | ○ |
| Example 19 | 22 | ○ | 240 | ○ | ○ |
| Example 20 | 0 | ○ | 650 | ○ | ○ |
| Example 21 | 0 | ○ | 400 | ○ | ○ |
| Example 22 | 0 | ○ | 470 | ○ | ○ |
| Example 23 | 23 | ○ | 330 | ○ | ○ |
| Example 24 | 8 | ○ | 260 | ○ | ○ |
| Example 25 | 29 | ○ | 310 | ○ | ○ |
| Example 26 | 0 | ○ | 520 | ○ | ○ |
| Example 27 | 26 | ○ | 410 | ○ | ○ |
| Example 28 | 10 | ○ | 420 | ○ | Q |

*Others include inevitable impurities such as $TiO_2$ and MgO.

TABLE 4

| | Chemical composition (wt %) (concentration as an oxide) | | | | | | | | Gas flow rate ($Nm^3/h$) | | Crystallization ratio at 3 minutes after thermal spraying (wt %) | Adhesion strength with respect to silica brick ($kg/cm^2$) | |
|---|---|---|---|---|---|---|---|---|---|---|---|---|---|
| | $SiO_2$ | CaO | $Fe_2O_3$ | $Al_2O_3$ | $Li_2O$ | $Na_2O$ | $K_2O$ | Others* | $C_3H_5$ | $O_2$ | | 10 minutes after thermal spraying | After 100% crystallization |
| Comparative example 10 | 95.0 | 3.0 | 0.4 | 0.5 | — | — | 0.1 | 1.0 | 27 | 200 | 0 | 70 | 1 |
| Comparative example 11 | 93.1 | 3.0 | 0.4 | 1.5 | — | 1.0 | 0.1 | 0.9 | 20 | 160 | 47 | 270 | 20 |
| Comparative example 12 | 91.1 | 6.0 | 0.4 | 0.5 | 1.0 | — | 0.1 | 0.9 | 20 | 160 | 70 | 290 | 45 |
| Comparative example 13 | 90.0 | 6.0 | 0.4 | 0.5 | — | 2.1 | 0.1 | 0.9 | 17 | 135 | 65 | 350 | 45 |
| Comparative example 14 | 90.6 | 3.0 | 0.4 | 0.5 | 4.5 | — | 0.1 | 0.9 | 16 | 130 | 70 | 280 | 30 |
| Comparative example 15 | 90.6 | 3.0 | 0.4 | 0.5 | — | 4.5 | 0.1 | 0.9 | 15 | 120 | 76 | 310 | 90 |
| Comparative example 16 | 95.0 | 3.0 | 0.4 | 0.5 | 0.1 | 0.1 | 0.1 | 0.8 | 27 | 200 | 67 | 90 | 10 |
| Comparative example 17 | 88.0 | 6.0 | 0.4 | 0.5 | 0.1 | 0.5 | 0.1 | 0.5 | 16 | 130 | 56 | 250 | 15 |

| | Adhesion strength by the crystallization | | Compression strength | | |
|---|---|---|---|---|---|
| | Lowering ratio (%) | Evaluation ≦30% is preferable | ($kgf/cm^2$) | Evaluation ≧200 $kgf/cm^2$ is preferable | Comprehensive evaluation |
| Comparative example 10 | 99 | x | 170 | x | x |
| Comparative example 11 | 93 | x | 250 | ○ | x |
| Comparative example 12 | 84 | x | 410 | ○ | x |
| Comparative example 13 | 87 | x | 370 | ○ | x |
| Comparative example 14 | 89 | x | 390 | ○ | x |
| Comparative example 15 | 71 | x | 340 | ○ | x |
| Comparative example 16 | 89 | x | 150 | x | x |
| Comparative example 17 | 94 | x | 380 | ○ | x |

*Others include inevitable impurities such aa $TiO_2$ and MgO.

INDUSTRIAL APPLICABILITY

According to a mending material of the present invention, since the crystallization ratio immediately after thermal spraying is high so as to provide a dense thermal spray mending layer, the difference can hardly be found with the furnace wall brick in terms of the heat expansion characteristics when the crystallization ratio of the thermal spray mending layer becomes 100% (at the time of expansion) so that the crack generation or the adhesion strength decline can be prevented as well as a thermal spray mending layer with a high compression strength can be obtained and thus it is excellent in terms of the wear resistance and durability (life).

Moreover, since a dense thermal spray mending layer having a high crystallization ratio immediately after thermal spraying can be obtained in a material mainly containing $SiO_2$, including 2.0 to 5.0% by weight of CaO and 1% by weight or less of $Al_2O_3$, the difference can hardly be found with the furnace wall brick in terms of the heat expansion characteristics when the crystallization ratio of the thermal spray mending layer becomes 100% (at the time of expansion) so that crack generation or adhesion strength decline can be prevented and a thermal spray mending layer having a high compression strength can be obtained. Thus, it is excellent in terms of wear resistance and durability (life).

Besides, a material of the present invention can make the above-mentioned thermal spray mending layer with a slight amount of oxygen gas and propane gas.

What we claim is:

1. A powdery mixture for flame spray mending of an interior silica brick wall of an industrial furnace, said mixture comprising not less than 89% by weight of $SiO_2$, from more than 2.0 to 4.0% by weight $Na_2O$, further comprising 0.2 to 4.0% by weight of $Li_2O$, and CaO containing substance and inevitable impurities as the remainder.

2. A powdery mixture for flame spray mending an interior silica brick wall of an industrial furnace, said mixture comprising not less than 89% by weight of $SiO_2$, 0.2% by weight or more of $Li_2O$, and from more than 0.2 to 4.0% by weight of ($Na_2O$+$Li_2O$), and CaO containing substance and inevitable impurities as the remainder.

3. A powdery mixture for flame spray mending an interior silica brick wall of an industrial furnace, said mixture comprising not less than 89% by weight of $SiO_2$, from more than 2.0 to 5.0% by weight of CaO, 0.5 to 4.0% by weight of $Na_2O$, 1.0% by weight or less of $Al_2O_3$, and inevitable impurities as the remainder.

4. A powdery mixture for flame spray mending an interior silica brick wall of an industrial furnace, said mixture comprising not less than 89% by weight of $SiO_2$, from more than 2.0 to 5.0% by weight of CaO, 0.2% by weight or more of $Li_2O$, from more than 0.2 to 4.0% by weight of ($Na_2O$+$Li_2O$), 1.0% by weight or less of $Al_2O_3$, and inevitable impurities as the remainder.

5. A product of flame spraying a powdery mixture according to claim 1,2,3 or 4 onto an interior silica brick wall of an industrial furnace, wherein said product has a crystallization ratio of 80% or more, said crystallization ratio defined as a ratio of crystobalite, trydymite, and quartz after flame spraying, and wherein compression strength of the product is 200 kgf/$cm^2$ or more.

6. The powdery mixture defined in claim 3 or 4, wherein the amount of $Na_2O$ is 1.0 to 3.0% by weight.

* * * * *

UNITED STATES PATENT AND TRADEMARK OFFICE

CERTIFICATE OF CORRECTION

PATENT NO. : 6,322,622 B1
DATED : November 27, 2001
INVENTOR(S) : Matsunaga et al.

It is certified that error appears in the above-identified patent and that said Letters Patent is hereby corrected as shown below:

Column 2,
Line 55, please change "SiO2" to -- $SiO_2$ --.

Column 3,
Line 35, please change "Li2O" to -- $Li_2$ O --.

Column 4,
Line 24, please change "SiO2" to -- $SiO_2$ --; and
Line 26, please change "$Fe_2$O3" to -- $Fe_2$ $O_3$ --.

Column 6,
Line 49, please change "SiO2" to -- $SiO_2$ --; and
Line 51, please change "TiO2" to -- $TiO_2$ --.

Column 8,
Line 49, please change "SiO2" to -- $SiO_2$ --.

Column 12,
Table 3, at the subheading "Comprehensive evaluation" the last row, please change "Q" to -- ○ --.

Signed and Sealed this

Eleventh Day of June, 2002

*Attest:*

*Attesting Officer*

JAMES E. ROGAN
*Director of the United States Patent and Trademark Office*